United States Patent [19]

Hamblin

[11] 4,098,482

[45] Jul. 4, 1978

[54] SHELF SUPPORTS

[75] Inventor: Richard David Hamblin, Birmingham, England

[73] Assignee: Archibald Kenrick and Sons Limited, West Midlands, United Kingdom

[21] Appl. No.: 831,874

[22] Filed: Sep. 9, 1977

[30] Foreign Application Priority Data

Sep. 10, 1976 [GB] United Kingdom ..... 37569/76

[51] Int. Cl.[2] ..... A47G 29/02

[52] U.S. Cl. ..... 248/246; 248/316 F

[58] Field of Search ..... 248/243, 244, 245, 246, 248/316 F, 241

[56] References Cited

U.S. PATENT DOCUMENTS

| | | | |
|---|---|---|---|
| 745,873 | 12/1903 | Mancha | 248/243 |
| 2,677,519 | 5/1954 | Hobson | 248/246 |
| 3,572,626 | 3/1971 | Bertschi | 248/243 |
| 4,033,540 | 7/1977 | Hamblin | 248/246 |

FOREIGN PATENT DOCUMENTS

| | | | |
|---|---|---|---|
| 6,410,236 | 3/1965 | Netherlands | 248/244 |

*Primary Examiner*—Robert A. Hafer

*Attorney, Agent, or Firm*—Finnegan, Henderson, Farabow & Garrett

[57] ABSTRACT

A shelf support comprising a member adapted for attachment vertically to a wall, the member defining an internal channel and an outwardly facing slot formed by a pair of opposing lips, a shelf support bracket having a shelf supporting portion and a blade portion extending into the channel through the lips, a pair of projections on the blade portion engaging the inner surfaces of the lips, and a pair of channel-engaging wedges pivotably supported by the blade portion and extending along the surface thereof, the wedges having respective integral pegs which are frictionally interengageable to form a bearing on which the wedges pivot with respect to the blade portion, the blade portion being frictionally inserted between the wedges so that the bracket is supported against movement in the channel by the frictional forces between the wedges and the channel and also the cantilever effect of the bracket, for stepless adjustability of said bracket.

3 Claims, 5 Drawing Figures

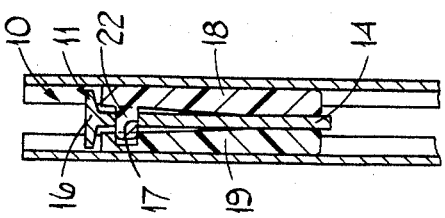
FIG. 3.
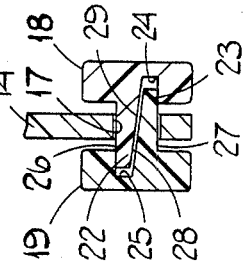
FIG. 4.
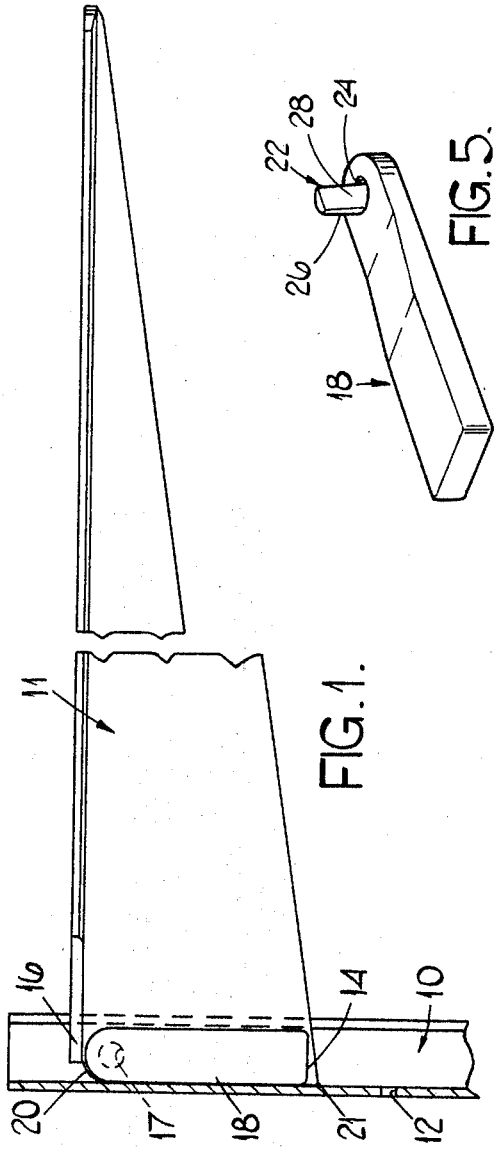
FIG. 1.
FIG. 5.
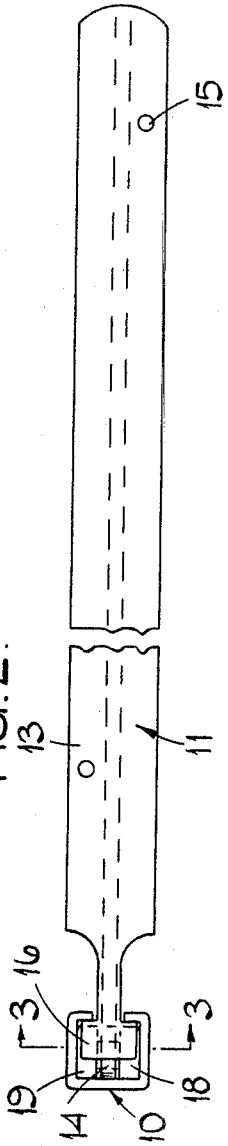
FIG. 2.

SHELF SUPPORTS

This invention relates to shelf supports of the kind comprising at least one member adapted for attachment vertically to a wall or other structure, on which a shelf is to be mounted, and at least one shelf support bracket which is detachably securable on the member in any one of a number of alternative positions along the length thereof.

It is usual to provide two or more of the members with respective brackets secured thereon, for a single shelf. More than one bracket may be provided on each of the members to support more than one shelf respectively.

In the Complete Specification of my British Patent Application No. 21731/74 there is described a shelf support of this kind and in Claim 1 thereof there is claimed a shelf support comprising a member adapted for attachment vertically to a wall or other structure, said member including an internal channel of uniform dimensions throughout its length and an outwardly facing slot formed by a pair of opposing lips, a bracket having a shelf-supporting portion and a generally triangular flange depending from the shelf-supporting portion, said flange including a blade portion extending into said channel through said lips, a pair of projections extending outwardly from the upper edge of said blade portion for engaging the inner surfaces of said lips, and a pair of channel-engaging wedges pivotably supported by said blade portion and extending along the surfaces of the blade portion extending into said channel, said blade portion being frictionally inserted between said wedges and having a surface for engaging the inner rear surface of said member for rigidly supporting said bracket against movement in said channel, both by the oppositely acting purely frictional engagement between the lip-engaging projections and the channel-engaging surface of the blade portion, and the frictional engagement of said wedges with the channel by insertion of the blade portion for stepless adjustability of said bracket.

The object of this invention is to provide improvements in the shelf support as claimed in the above patent application.

According to the present invention a shelf support comprises a member adapted for attachment vertically to a wall or other structure, said member including an internal channel of uniform dimensions throughout its length and an outwardly facing slot formed by a pair of opposing lips, a bracket having a shelf-supporting portion and a generally triangular flange depending from the shelf-supporting portion, said flange including a blade portion extending into said channel through said lips, a pair of projections extending outwardly from the upper edge of said blade portion for engaging the inner surfaces of said lips, and a pair of channel-engaging wedges pivotably supported by said blade portion and extending along the surfaces of the blade portion extending into said channel, said blade portion being frictionally inserted between said wedges and having a surface for engaging the inner rear surface of said member for rigidly supporting said bracket against movement in said channel, both by the oppositely acting purely frictional engagement between the lip-engaging projections and the channel-engaging surface of the blade portion, and the frictional engagement of said wedges with the channel by insertion of the blade portion for stepless adjustability of said bracket, characterised in that the wedges are pivotably supported by said blade portion by means comprising frictionally interengageable pegs formed integrally with the wedges respectively, said pegs passing through an opening in said blade portion of the bracket and together forming a bearing on which said wedges pivot with respect to said blade portion of the bracket.

The invention will now be described by way of example with reference to the accompanying drawings in which:

FIG. 1 is a side elevation view of a shelf support constructed in accordance with the invention, FIG. 2 is a plan view thereof, FIG. 3 is a sectional view on the line 3—3 in FIG. 2, FIG. 4 is a fragmentary, exploded, enlarged sectional view showing how two components of the shelf support are connected to a flange thereof, and FIG. 5 is a perspective view of one of the components shown in FIG. 4.

The shelf support comprises a member 10 for attachment to a vertical surface on which a shelf is to be mounted and a shelf support bracket 11 securable at any selected position along the length of the member 10 as will be described.

The member 10 is of channel cross-section with inward turned lips as shown in FIG. 2. The member 10 is of uniform cross-section throughout and is adapted for mounting onto a vertical surface by means of screws or other fastenings engageable in holes 12 spaced lengthwise of the member.

The shelf support bracket 11 is of substantially T-shaped cross-section over the greater part of its length defining a narrow platform 13 integrally connected with a generally triangular flange 14. The platform 13 has spaced holes 15 to accept screws or other fastenings whereby a shelf can be secured thereto. The platform 13 terminates at a position spaced from the member 10 into which, however, the triangular flange 14 extends. Furthermore, there are two integral generally rectangular projections 16 on a blade portion of the flange 14, said blade portion extending between the lips into the channel of the member 10. The projections 16 are co-planar with the platform 13 and engage behind the lips of the channel of the member 10 respectively.

In the corner of the triangular flange 14, at which these projections 16 are provided, there is a hole 17 to receive respective pegs of a pair of wedges 18, 19 as will be described. Moreover, this corner of the triangular flange is radiused at 20. The lower corner of the flange is also radiused, at 21.

The wedges 18, 19 are disposed within the member 10 at opposite sides of the flange 14. Each of the wedges 18, 19 is of generally rectangular configuration having, however, mutually, diverging, facing surfaces disposed at opposite sides of the triangular flange 14 of the shelf support bracket 11.

At their thinner ends, the wedges 18, 19 are provided with respective integral pegs 22, 23. These pegs extend normally from the surfaces of the wedges respectively presented towards the flange 14 in the channel member 10. Although only the wedge 18 is shown in FIG. 5, the wedge 19 is identical.

The cross-section of each peg is a segment of a circle, part of which is defined by the surved periphery of the peg and the remainder of which is defined by a segment shaped hole in the wedge. The holes are shown as 24, 25 for the wedges 18, 19 respectively in FIG. 4.

The cross-section of each peg decreases as it extends away from its associated wedge so that, correspondingly, the cross-section of the hole increases towards the surface of the wedge, at which position it is substantially a full semi-circle. The pegs 18, 19 thus have part cylindrical surfaces 26, 27 respectively and respective flat surfaces 28, 29, each flat surface being inclined relatively to the surface of its associated wedge.

The pegs extend from their associated wedges by equal amounts so that it is possible for the pegs to be frictionally interengaged, with the end of the peg 22 fitting in the hole 25 in the wedge 19 and the end of the peg 23 fitting in the hole 24 in the wedge 18. When interfitted in this manner the pegs together form a cylindrical bearing with the flat surfaces 28, 29 in contact.

The hole 17 in the corner of the triangular flange 14 is of a size slightly larger than the cylindrical bearing formed by the interengagement of the pegs 22, 23 and as shown in FIG. 3, the bearing passes through the hole 17, in use, so that the wedges can pivot together with respect to the portion of the bracket within the channel member 10. In the position shown in FIGS. 2 and 3, therefore, the wedges are quite securely connected to the bracket.

The wedges 18, 19 are of a size such that when the flange 14 is disposed between them as illustrated in the drawings, they fill the remaining space in the channel defined by the member 10 so as to grip the flange 14 and prevent the shelf support bracket 11 sliding downwardly of the member 10. The wedges are made from resilient material which may be a plastics material, and the member 10 may have sufficient resilience to allow limited expansion so as to create maximum frictional resistance to sliding movement of the wedges 18, 19 within it.

The shelf support bracket with its platform 13 substantially horizontal is thus prevented from sliding lengthwise of the member 10, that is normally in a vertical direction not only by the frictional forces between the wedges 18, 19 and the channel of the member 10, but also by the cantilever effect of the bracket. Frictional engagement takes place between the projections 16 and the lips of the member 10, and also between the vertically disposed edge of the triangular flange 14 against the interior of the base of the channel.

If it is desired to adjust the position of the shelf support bracket 11 lengthwise of the member 10 it is necessary to pivot the shelf support bracket about the bearing formed by the pins 22, 23 so as to withdraw the flange 14 from between the wider end portions of the two wedges 18, 19. The assembly comprising the shelf support bracket 11 and the two wedges 18, 19 can now slide lengthwise of the member 10 without, however, becoming detached therefrom. When the correct adjusted position is reached, the shelf support bracket 11 is pivoted downward to the position shown in the drawings whereupon wedging engagement takes place to secure the bracket. Thus, stepless adjustment of the bracket is easily accomplished.

To suppot a shelf it is usual to provide two or more of the members 10 which should be substantially parallel. Shelf support brackets 11 are fitted into these members 10 respectively and the height thereof can be adjusted in a stepless manner as required. More than one shelf support bracket 11 may be provided on each one of the members 10 respectively. Fitting and removal of the shelf support brackets to the members takes place at the end of the members but cannot be accomplished at any point between the ends.

The form and configuration of the platform of the shelf support bracket may vary in accordance with the kind of shelf to be supported.

It can be seen that the shelf support of the present invention possesses several advantages over that in my British Patent Application No. 21731/74.

Firstly, once their pegs have been passed through the hole 17 and interengaged, the wedges cannot move relatively to each other. This makes entry of the wedges into the member 10 much easier than with the case where the wedges can pivot independently of one another on a pivot pin. Secondly, the number of components is reduced by the elimination of the pivot pin. Thirdly, with the shelf support bracket pivoted relative to the wedges 18, 19, the wedges can be closed tightly onto the portion of the bracket remaining between them, so as to allow extra clearance for entry into the member 10.

Other improvements include an increase in size of the projections 16 and an increase in the width of the narrow portion of the bracket connecting the projections 16 to the platform 13. Moreover, said narrow portion is now joined to the platform 13 by radiused portions. All these changes improve the strength and carrying capacity of the bracket.

Thus, it can be seen that the provision of interengageable pegs on the wedges respectively enables easy assembly of the wedges onto the portion of the shelf support bracket engageable in the lipped channel to be undertaken and, moreover, enables the wedges to be received easily into the lipped channel.

I claim:

1. A shelf support comprising a member adapted for attachment vertically to a wall or other structure, said member including an internal channel of uniform dimensions throughout its length and an outwardly facing slot formed by a pair of opposing lips, a bracket having a shelf-supporting portion and a generally triangular flange depending from the shelf-supporting portion, said flange including a blade portion extending into said channel through said lips, a pair of projections extending outwardly from the upper edge of said blade portion for engaging the inner surfaces of said lips, and a pair of channel-engaging wedges pivotably supported by said blade portion and extending along the surfaces of the blade portion extending into said channel, said blade portion being frictionally inserted between said wedges and having a surface for engaging the inner rear surface of said member for rigidly supporting said bracket against movement in said channel, both by the oppositely acting purely frictional engagement between the lip-engaging projections and the channel-engaging surface of the blade portion, and the frictional engagement of said wedges with the channel by insertion of the blade portion for stepless adjustability of said bracket, characterised in that the wedges are pivotably supported by said blade portion by means comprising frictionally inter-engageable pegs formed integrally with the wedges respectively, said pegs passing through an opening in said blade portion of the bracket and together forming a bearing on which said wedges pivot with respect to said blade portion of the bracket.

2. A shelf support as claimed in claim 1 wherein the cross-section of each peg is a segment of a circle, part of which circle is defined by the curved periphery of the peg and the remainder of which is defined by a segment shaped hole in the wedge, the pegs being frictionally interengaged, in use, with the ends of the pegs fitting in the segment shaped holes in opposite wedges respectively, the pegs thereby forming said bearing.

3. A shelf support as claimed in claim 2 in which the cross-section of each peg decreases away from its associated wedge.

* * * * *